United States Patent [19]

Potma et al.

[11] 4,088,256

[45] May 9, 1978

[54] DEVICE FOR PRINTING DATA

[75] Inventors: Theodorus Gerhardus Potma; Egbertus Nicolaas Bijkerk; Marius Quirijnen, all of Rijswijk, Netherlands

[73] Assignee: U.S. Philips Corporation, New York, N.Y.

[21] Appl. No.: 741,233

[22] Filed: Nov. 12, 1976

Related U.S. Application Data

[63] Continuation of Ser. No. 502,955, Sep. 4, 1974, abandoned.

[30] Foreign Application Priority Data

Sep. 18, 1973 Netherlands ..... 7312807

[51] Int. Cl.[2] ..... B65H 17/42

[52] U.S. Cl. ..... 226/74; 226/115

[58] Field of Search ..... 226/4, 74, 75, 108, 226/111, 115, 117, 118

[56] References Cited

U.S. PATENT DOCUMENTS

| | | | |
|---|---|---|---|
| 3,447,729 | 6/1969 | Cass | 226/49 |
| 3,583,618 | 6/1971 | Lewis | 226/49 |
| 3,800,992 | 4/1974 | Yamagishi | 226/74 X |

*Primary Examiner*—Richard A. Schacher
*Attorney, Agent, or Firm*—Frank R. Trifari; Robert S. Smith

[57] ABSTRACT

A device for printing data on a paper chart which is provided on both sides with a perforation track. The device comprises at least one pair of tractors, one of which engages in the one perforation track while the other engages in the other perforation track so as to transport the paper chart along the printing location. The device furthermore comprises a paper guide for guiding the paper after its departure from the tractors. A paper drawing device is arranged substantially at the end of the guide and is coupled to the drive system for the tractor pair by way of an elastic transmission.

9 Claims, 3 Drawing Figures

DEVICE FOR PRINTING DATA

Figure 1:
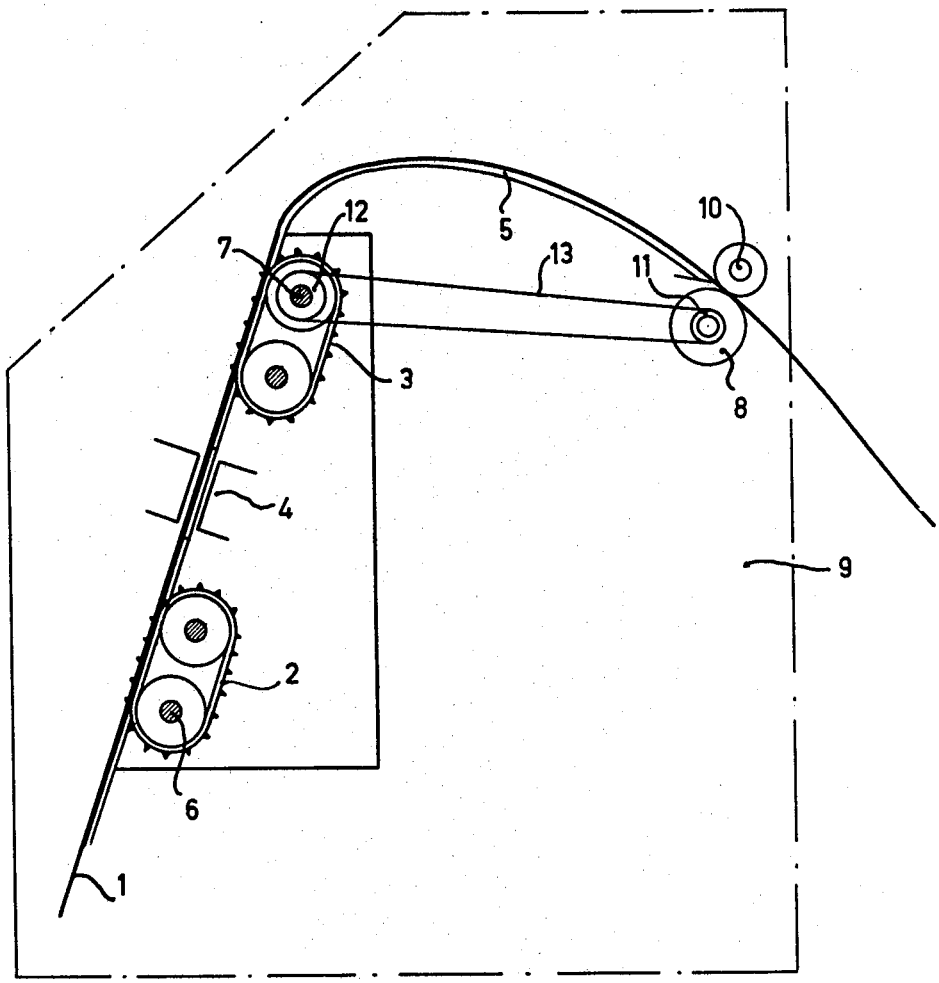

This is a continuation of application Ser. No. 502,955, filed Sept. 4, 1974, now abandoned.

The invention relates to a device for printing data on a paper chart which is provided on both sides with a perforation track, the said device comprising at least one pair of tractors, one tractor engaging in the one perforation track and the other tractor engaging in the other perforation track in order to move the paper chart along the printing location, and a paper guide for guiding the paper after its departure from the tractors, at least one paper drawing device being arranged substantially at the end of this guide.

In known devices of the kind set forth the paper is advanced one line after the other, which produces a substantially erratic movement of the paper. Consequently, the paper chart is liable to jam during the movement over the guide after its departure from the tractors, thus causing a breakdown. In order to avoid this drawback, a paper drawing device is arranged in the guide in the known machines as near as possible to the exit opening. In the known embodiments this paper drawing device consists of at least two friction rollers which are situated in front of and behind the paper chart. One of these rollers is pressed, and the other one is continuously driven. The latter thus exerts a continuous tensile force on the paper. A drawback thereof is the low admissible tensile force because otherwise excessive wear of the paper and the friction rollers occurs.

A further drawback is that a continuous drive must be provided, which usually necessitates an additional continuously operating motor.

In other known devices (U.S. Pat. No. 3,464,610), a paper stacking mechanism is arranged at the end of the paper guide, the said mechanism comprising a further pair of tractors for the paper which perform a reciprocating, swinging stacking movement. In the known device a separate motor is provided for driving the further tractors. A drawback of this known device is that the measuring system for controlling the drive motor requires a large paper loop.

The invention has for its object to provide a device of the kind set forth in which the said drawbacks are eliminated.

So as to realize this object, the device according to the invention is characterized in that the paper drawing device is coupled to the drive for the tractor pair by way of an elastic transmission.

In the device according to the invention only one common motor is required for driving the first tractor pair and the paper drawing device, the driving of the paper drawing device being much more uniform, due to the elastic transmission, than that of the first tractor pair, with the result that the peak capacity of the motor need not be inadmissibly high. When the paper drawing device is formed by two friction rollers as in a further preferred embodiment, the first roller is coupled by way of an elastic transmission to the drive of the tractor pair, the transmission being such that the path completed by the roller exceeds the path completed by the tractors.

The friction rollers will then move only when really necessary, or in other words, when paper is being transported. Consequently, it will be possible to increase the tensile force to improve the effect. The transmission can be formed by an elastic belt or other elastic shaft coupling.

Because the transmission is chosen such that the roller completes a longer path than the tractors, it is ensured that the paper chart between the tractors and the paper drawing device is always smoothly taut. This, of course, requires some slip between roller and paper.

A further preferred embodiment is characterized in that the transmission acts in only one direction, preferably while using a free-running coupling. This prevents oscillation of the mass spring system formed by the elastic transmission and the mass inertia of the paper drawing device.

A further preferred embodiment yet in which the paper drawing device is formed by a further tractor pair which also performs a reciprocating swinging paper stacking movement is characterized in that the transmission between the two tractor pairs is formed by a chain or toothed belt which is guided over two guide wheels which are arranged on a yoke which extends transverse to the direction of the chain or belt, the said yoke being movable against spring force in the direction transverse to the movement direction of the chain or belt. In a further preferred embodiment the yoke is also provided with a shock absorber.

The advantages of the described device are that no accumulation of faults can occur in that now a slip-free transmission between the two tractor pairs is used. A separate drive motor and measuring system are no longer required for driving the further tractor pair.

The invention will be described in detail hereinafter with reference to the drawing.

FIG. 1 diagrammatically shows (not to scale) a device for printing data which is provided with a paper drawing mechanism in the form of two friction rollers.

Figure 2:
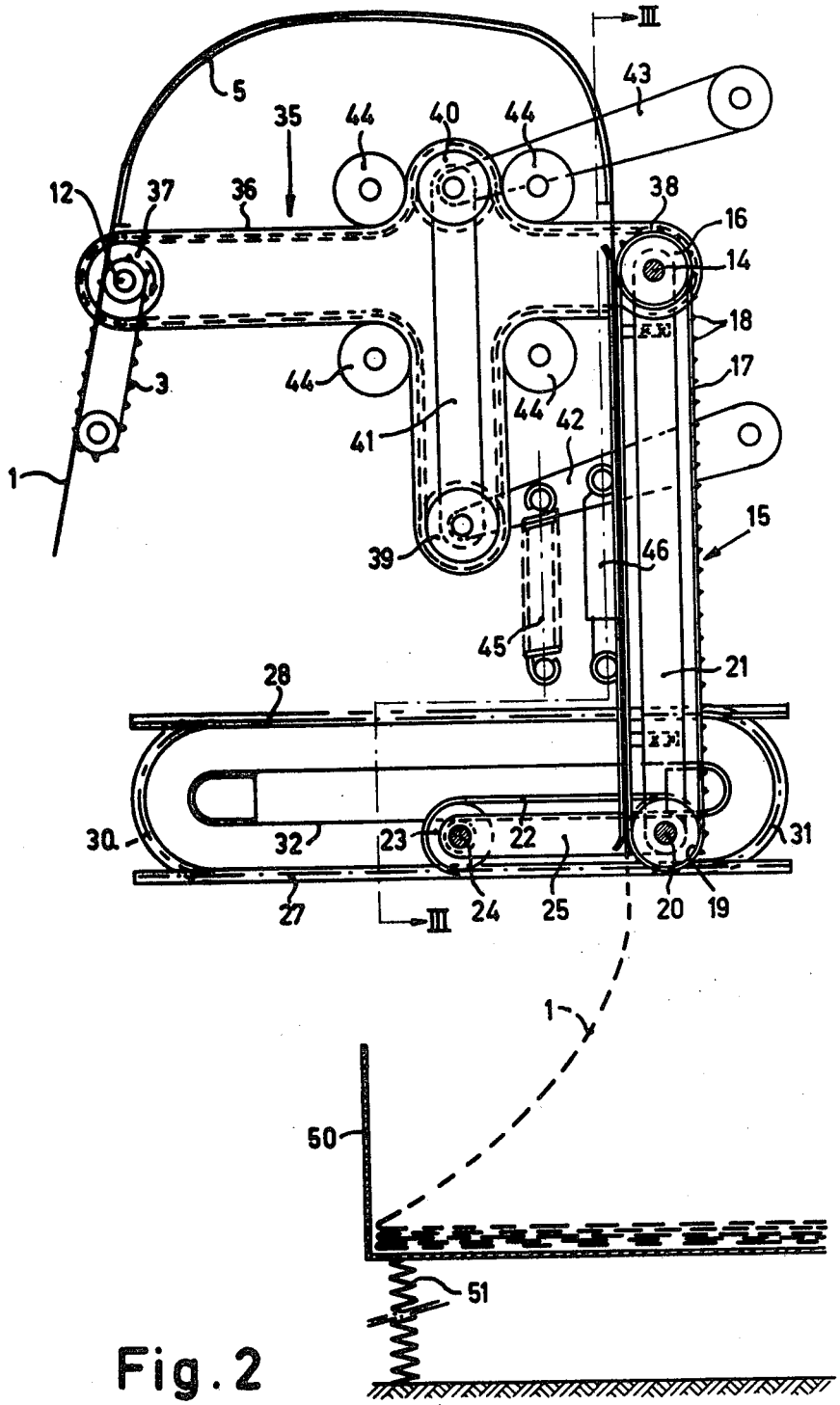
Figure 3:
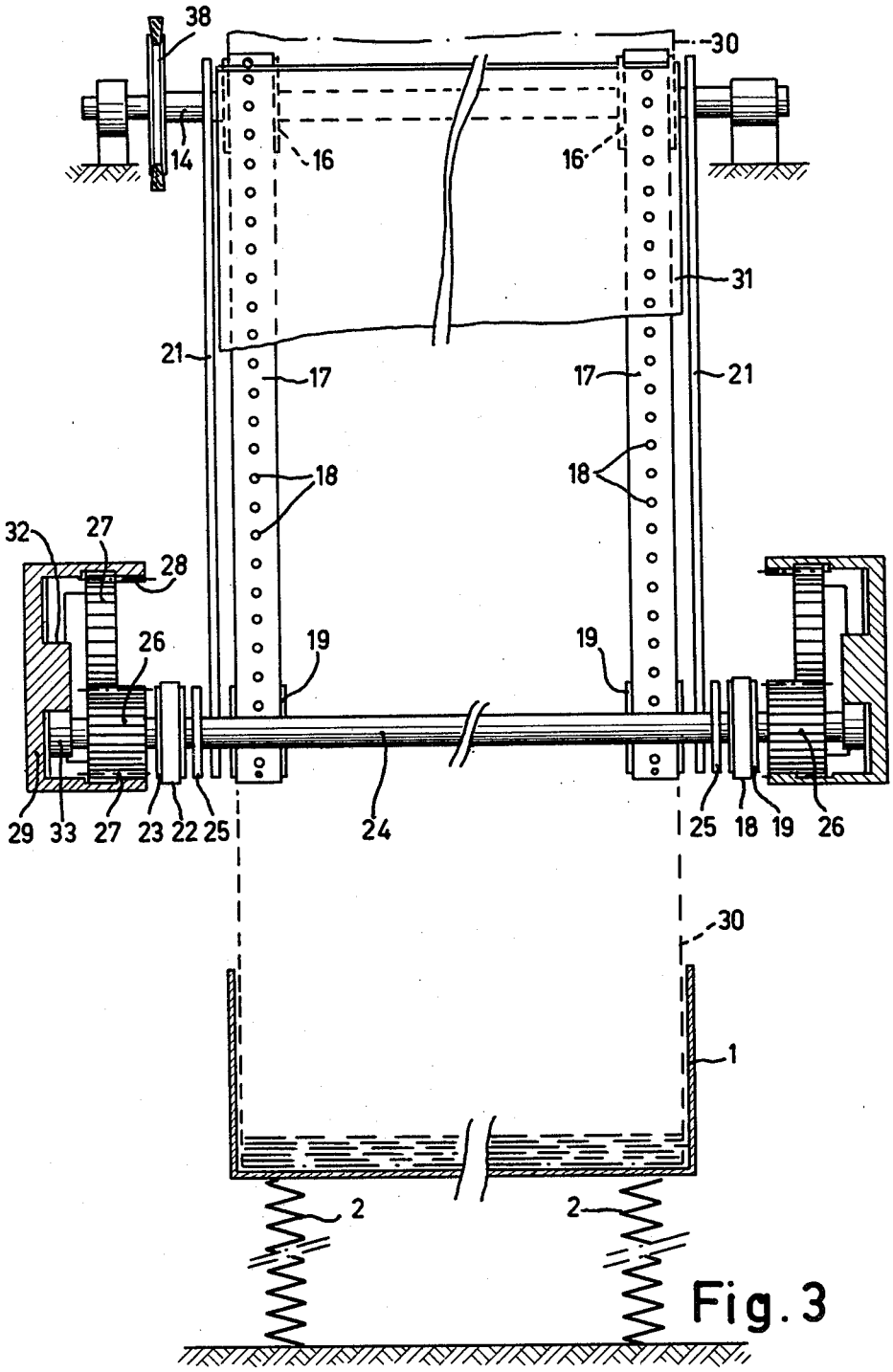

FIGS. 2 and 3 diagrammatically show (not to scale) a device for printing data, comprising a paper drawing device in the form of a paper stacking mechanism.

The reference numeral 1 in FIG. 1 denotes a paper chart which can be fed along a printing position 4, of which is disposed a printing mechanism by two pairs of tractors 2 and 3. After its departure from the upper tractor pair 3, the paper chart is guided over a paper guide 5. The shafts 6, 7 of each tractor pair are coupled to a drive.

Arranged at the end of the paper guide 5 is a roller 8 which is journalled to be rotatable in the frame 9 of the device. Arranged on the other side of the paper chart is a pressure roller 10 which is resiliently pressed, by means not shown, against the roller 8 or against the paper present between the rollers. Arranged on the shaft of the roller 8 is a pulley 11 via a free-running coupling which is not shown in detail. An elastic belt 13 is arranged over the pulley 11 and a pulley 12 on the shaft 7 of the tractor pair 3.

When the tractor pair 3 is driven, the roller 8, constituting a paper drawing device together with pressure roller 10, will thus also be driven. Due to the elastic construction of the belt 13, the starting torque will not be excessively large, with the result that the drive motor of the shafts 6 and 7 need only be slightly larger for driving also the paper drawing device. The pulley 11 is chosen such that the path completed by roller 8 is slightly longer than that completed by the tractors 2 and 3, with the result that always some slip occurs between paper and roller 8, so that the paper will always be taut.

The use of the free-running coupling between the pulley 11 and the roller 8 completely eliminates the risk of oscillation of the mass spring system formed by elastic drive and mass of the roller 8.

Because of the presence of the free-running coupling, the roller 8 will be braked only by the paper, so the paper will be additionally pulled taut.

Instead of an elastic belt, use can alternatively be made of another type of elastic coupling between the tractors 7 and roller 8, without affecting the operation of the device.

FIG. 2 is a side elevation of a device for printing data which comprises a paper stacking mechanism.

The drawing again shows the tractor pair 3 which again transports the paper chart 1 along the printing location which is not shown in this figure. The paper passes from the tractor pair 3 over a paper guide 5 to a paper stacking mechanism 15 which comprises a shaft 14 having provided thereon two pulleys 16 over which belts 17 are guided, each belt comprising a number of pins 18. The belts 17 are further guided over two pulleys 19 provided on a second shaft 20. The second shaft 20 is journalled on the first shaft by way of two levers 21. Also provided on the second shaft is a pulley over which a belt 22 is guided which extends further over a pulley 23 on a shaft 24.

This shaft 24 is connected on both sides, by way of an arm 25, to the shaft 20, and the shaft 24 is furthermore provided on both ends with a gearwheel 26. This gearwheel 26 co-operates with a rack assembly provided with interior teeth and consisting of two parallel racks 27 and 28, mounted in a frame 29, and two semi-circular gear rings 30 and 31 which constitute a connection between the ends of the racks 27 and 28. The gear rings 30 and 31 are slidable in the frame 29 in the longitudinal direction of the racks 27 and 28, with the result that the distance between the rings can be adjusted as desired.

The frame 29 is furthermore provided with a running surface 32 along which a wheel 33, connected to gearwheel 26, rolls down. The shaft 12 of the tractor 3 which can be driven by a motor (not shown in the drawing) is connected, by way of an elastic coupling 35, to the shaft 14 of the paper stacking mechanism 15.

The elastic coupling is formed by a toothed belt 36 which is guided on the one side over a pulley 37 on the shaft 12 and on the other side over a pulley 38 on the shaft 14.

The belt 36 is further guided over two guide wheels 39 and 40 which are provided on a yoke 41 which is pivotably connected to two arms 42 and 43 which are pivotably connected to the frame of the device.

The belt 36 is further guided by four rigidly arranged guide wheels 44.

The arm 42 is furthermore connected, by way of a tensile spring 45 and a shock absorber 46, to the frame of the device.

During operation the shaft 7 of the tractors 3 is stepwise driven for the line-wise transport of the paper along the printing location of the printing device. When the shaft 7 is driven, the mass inertia of the paper stacking mechanism causes the belt 36 to pull the guide wheel 39 upwards, so that the spring 45 is tensioned. The belt 36 remains taut because the wheel 40 has also been moved upwards. The spring 8 exerts a torque on the shaft 14, thus driving the paper stacking mechanism 15. The driving of the shaft 12 is stopped with a very long delay. Due to the mass inertia of the paper stacking mechanism, pulley 38 tends to continue rotating, and the braking thereof is controlled by the shock absorber 46. Due to this kind of coupling of tractors and paper stacking mechanism, it is achieved that, because of the slip-free driving of the stacking mechanism by means of a toothed belt, the length of paper supplied by the tractors 7 always corresponds exactly to the length of the paper processed by the stacking mechanism. It is also achieved that the driving of the stacking mechanism is more uniform than that of the tractors, so that the peak capacity of the drive is also less high than in the case of a rigid coupling of the shafts 12 and 14.

The paper 1 which arrives via the guide 5 and which is provided with folds at regular distances engages the pins 18 on the belts 17 by way of its perforation tracks.

When the shaft 14 is driven, the belts 17 move with the result that, because of the coupling of shaft 20 to shaft 24 as shown in the drawing, the gearwheels 26 start to roll down along the rack assembly 27, 30, 28, 31, with the result that a reciprocating swinging movement is imparted to the belts 17. As a result, the paper chart 1 is deposited in the folded condition in the bin 50.

In order to obtain a constant distance between paper take-off point and the top of the paper stack, the bin 50 is mounted on springs 51.

What is claimed is:

1. A device for printing data on an associated chart which includes a first perforation track on one side of said chart and a second perforation track on the other side of said chart, said device comprising: means for printing, and means for moving the associated chart which includes a first tractor engaging a section of the chart at said first perforation track and a second tractor engaging said section at said second track, said first and second tractors cooperating with the chart to advance the chart responsive to rotation of said first and second tractors, a paper guide cooperating with said section of the chart after said section disengages from said first and second tractors, at least one chart drawing device engaging said section of said chart after said guide, said drawing device being (1) coupled to one of said first and second tractors by a means for power transmission which includes an elastic element and (2) not coupled directly to any other driving means.

2. A device as claimed in claim 1, in which said drawing device comprises first and second friction rollers, said first roller being coupled to said means for power transmission, said means for power transmission providing a circumferential travel of said first roller that is longer than that completed by said tractors, said device further including means for urging said second roller toward said first roller.

3. A device as claimed in claim 2 wherein said means for power transmission acts in only one direction of rotation of said first roller.

4. A device as claimed in claim 2 wherein said elastic element is an elastic belt.

5. A device as claimed in claim 3 wherein said means for power transmission includes a one-way clutch.

6. A device as claimed in claim 3 in which said drawing device further includes third and fourth tractors and means for urging said third and fourth tractors in a reciprocating swinging paper stacking movement, means for power transmission between said first and second tractors and said third and fourth tractors including a drive member and two cooperating guide wheels which are arranged on a yoke which extends transverse to the direction of said drive member, said yoke being movable against spring force in the direction transverse to the movement direction of said drive member.

7. A device as claimed in claim 6 wherein said drive member is a belt.

8. A device as claimed in claim 6 wherein said drive member is a chain.

9. A device as claimed in claim 6, further including a shock absorber limiting movement of said yoke.

* * * * *